US009775440B1

(12) United States Patent
Chon et al.

(10) Patent No.: US 9,775,440 B1
(45) Date of Patent: Oct. 3, 2017

(54) ADJUSTABLE LEG PILLOW

(71) Applicant: Picasso Style LLC, Los Angeles, CA (US)

(72) Inventors: Jin Chon, Los Angeles, CA (US); Kevin Chon, Pasadena, CA (US)

( * ) Notice: Subject to any disclaimer, the term of this patent is extended or adjusted under 35 U.S.C. 154(b) by 0 days.

(21) Appl. No.: 15/409,465

(22) Filed: Jan. 18, 2017

(51) Int. Cl.
*A47C 20/00* (2006.01)
*A47G 9/10* (2006.01)

(52) U.S. Cl.
CPC ..... *A47C 20/021* (2013.01); *A47G 9/10* (2013.01); *A47G 2009/1018* (2013.01)

(58) Field of Classification Search
CPC ..... A47C 20/021; A47C 20/00; A47C 20/02
USPC ..... 5/630, 640, 648, 652, 657
See application file for complete search history.

(56) References Cited

U.S. PATENT DOCUMENTS 4,864,669 A 9/1989 Jones
4,959,880 A 10/1990 Tesch
5,363,524 A 11/1994 Lang
5,809,594 A 9/1998 Isogai
5,953,777 A 9/1999 Buck
6,760,935 B1 7/2004 Burton et al.
8,656,537 B2 2/2014 Leifermann et al.
2001/0003219 A1 6/2001 Chou
2001/0027577 A1* 10/2001 Frydman ..... A47C 20/021 5/648
2003/0052035 A1 3/2003 Dickinson
2006/0031996 A1 2/2006 Rawls-Meehan
2012/0073056 A1 3/2012 Freund et al.
2013/0263377 A1* 10/2013 Wootten, Jr. ..... A47C 23/00 5/640
2014/0338130 A1 11/2014 Russell

* cited by examiner

*Primary Examiner* — Fredrick Conley
(74) *Attorney, Agent, or Firm* — Zeller IP Group, PLLC; Kyle M. Zeller

(57) ABSTRACT

An adjustable pillow intended to support a user's knees or legs is provided. The pillow may include a cover sized to fit around a plurality of support pieces, including a front support piece, a back support piece, and one or more middle support pieces. The cover includes an aperture adapted to allow at least a middle support piece to be inserted or removed. The aperture is securable by a zipper or other fastening means. The support pieces may be made of a soft material, such as foam. The middle support pieces may comprise a material that is of greater density and of lower firmness than the front and back support pieces.

17 Claims, 5 Drawing Sheets

ADJUSTABLE LEG PILLOW

BACKGROUND

This specification relates generally to support devices. More particularly, the disclosure pertains to contoured pillows that are adjustable by a user.

Pillows are often used to support a part of a user's body during sleeping or resting. For example, pillows may be employed while sleeping on a bed or lying down on a couch to support a user's head, knees or legs.

Pillows for supporting knees and/or legs are used to help avoid putting unnecessary strain on the hip joint and lower back while a user is lying on his or her side. In addition, use of a properly supportive knee pillow may help in keeping the spine in proper alignment.

Unfortunately, conventional knee pillows are not adjustable. Such pillows typically consist of a fabric cover having a soft stuffing or filling therein. The cover is typically sealed such that a user is unable to access the filling contained therein to adjust the height of the pillow. Accordingly, a user of these pillows may need to purchase a new pillow if they change their resting position preference any time after a pillow purchase.

A number of adjustable pillows found in the prior art allow for pillow inserts or layers to be placed inside a pillowcase or shell. For example, U.S. Patent App. Pub. No. 2013/0263377; U.S. Pat. No. 5,953,777; and U.S. Pat. App. Pub. No. 2012/0073056 disclose customizable pillows having several inserts that can be placed inside a shell to adjust the thickness of the pillow. However, these references disclose conventional pillows for supporting the head while sleeping or resting. None of the references disclose an adjustable knee pillow having concave-shaped inserts to conform to a user's knees. Moreover, these references do not teach the use of multiple inserts made from materials of differing shape, height, density and/or firmness.

There is therefore a need for an adjustable knee pillow that allows a user to add or remove one or more internal support pieces to increase or decrease the height of the pillow. It would be beneficial if such a pillow included multiple inserts made from materials of differing firmness to allow for optimum conformation to a user's knees or legs.

SUMMARY

In accordance with the foregoing objectives and others, exemplary adjustable pillows are disclosed herein that can be employed to support a user's knees or legs while the user is resting or sleeping on their side. The pillow may comprise one or more support pieces disposed within a cover, with at least one support piece being removable from the cover. By removing a support piece from within the cover, a dimension of the pillow, such as height, width, or length, may be adjusted to the preference of the user. In one embodiment three support pieces may be used, with a removable inner piece, and two outer pieces (which may or may not be removable) contoured to fit the knees of a user. Alternative embodiments may include two or more inner support pieces.

The cover may include an aperture, or opening, sized to allow the insertion of at least one removable inner support piece. The aperture may be opened and/or closed by a fastening mechanism, such as a zipper. Each of the inner support pieces may be made of a soft material, such as foam. Each of the support pieces may be made from the same material or may be made from different materials. In one embodiment, the pillow may include outer support pieces made of a first material and one or more inner support pieces disposed between the outer support pieces, the inner support pieces made of a second material that is firmer than the first material.

The pillow may be made in various sizes to conform to the body of an individual using the pillow. For example, the pillow may be sized to fit the legs of an adult or a child In one embodiment, an adjustable pillow is provided wherein the pillow may be adapted to receive at least a portion of a user's legs during use. The pillow includes a cover having one or more panels (e.g., fabric or other material) joined to form an outer surface, an inner surface and an interior compartment sized to house a plurality of support pieces therein. The cover may further include a closable aperture extending from the outer surface to the inner surface of the cover, along one or more of the panels, the aperture sized to receive one or more support pieces therein. The cover may also include a fastening mechanism in communication with the aperture, the fastening mechanism adapted to allow a user to open the aperture for insertion of one or more support pieces into the interior compartment; and securely close the aperture such that the one or more support pieces remain within the interior compartment during use.

The adjustable pillow may include a front support piece disposed within the interior compartment of the cover. The front support piece may have a concave front surface; a substantially flat back surface; and substantially flat left, right, top and bottom surfaces extending from the front surface to the back surface. The front support piece may be made from a first material having a first firmness.

The adjustable pillow may also include a back support piece disposed within the interior compartment of the cover. The back support piece may have a concave back surface; a substantially flat front surface; and substantially flat left, right, top and bottom surfaces extending from the back surface to the front surface. The back support piece may be made from the same first material as the front support piece.

The adjustable pillow may further include a removable middle support piece disposed within the interior compartment of the cover, between the back surface of the front support piece and the front surface of the back support piece. The middle support piece may have substantially flat, rectangular front, back, left, right, top and bottom surfaces. The middle support piece may be made from a second material having a firmness that is greater than the firmness of the first material of the front and back support pieces. And the middle support piece may be shaped such that it may be inserted and/or removed by a user via the aperture in the cover.

The details of one or more embodiments of the subject matter of this specification are set forth in the accompanying drawings and the description below. Other features, aspects, and advantages of the subject matter will become apparent from the description, the drawings, and the claims.

DETAILED DESCRIPTION

Various adjustable leg pillows are disclosed herein that allow for the addition and/or removal of a support piece such that the size of the pillow may be adjusted as desired or required by a user. The disclosed adjustable pillows comprise several support pieces and a cover surrounding the support pieces. A user may access the inside of the pillow, including the support pieces, through an aperture in the cover, which may be opened through the use of a fastening means such as a zipper. The user may then add or remove one or more support pieces, in order to adjust the size or shape of the pillow.

Figure 1A:
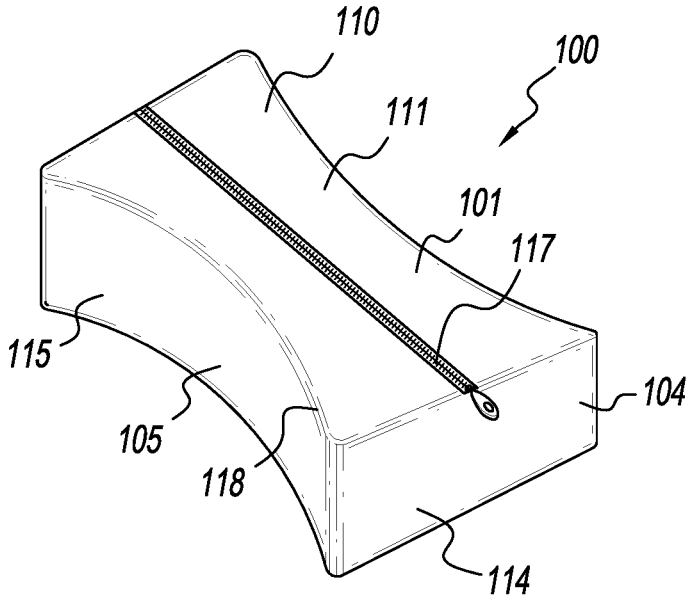
FIGS. 1A and 1B illustrate top and bottom perspective views of an exemplary adjustable leg pillow 100 comprising a cover 110 having a fastening mechanism 117 in a closed position.
Figure 1B:
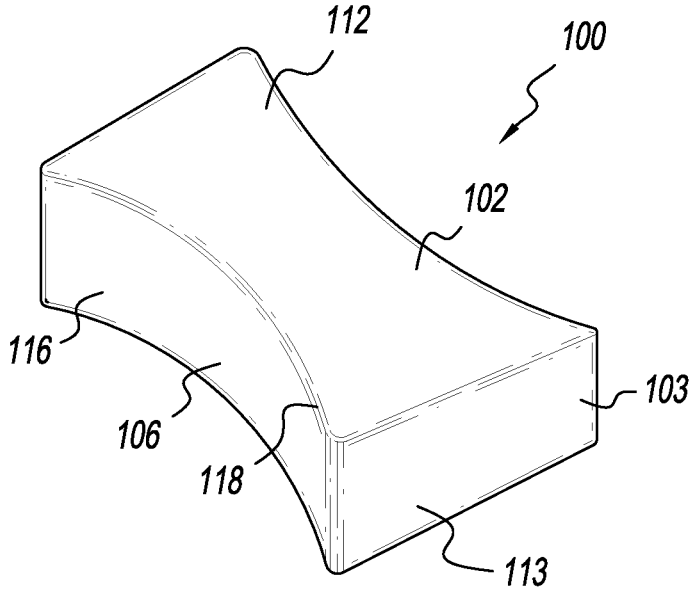

Referring to FIGS. 1A and 1B, top and bottom perspective views of an exemplary adjustable pillow 100 are illustrated, respectively. As shown, the adjustable pillow 100 comprises a top 101 and a bottom 102 connected via two long sides (i.e., a front side 105 and a back side 106), and two short sides (i.e., a left side 103 and a right side 104). The top 101, bottom 102, left side 103 and right side 104 of the adjustable pillow 100 may be substantially flat. And the front side 105 and back side 106 may be concave.

The adjustable pillow 100 is sized and shaped to provide support for, and/or proper alignment of, a user's knees, hips, back, and/or spine. In addition, the specific curvature of the concave front and back sides (105, 106) may be adapted to conform to the knees of a user. Because different users will have different physical characteristics, pillows may be made of varying sizes and shapes. For example, one embodiment of an adjustable pillow 100 may be sized to fit an adult female of average size, and another embodiment may be sized to fit a child. The dimensions listed below are only examples of dimensions that may be used.

The pillow may comprise a length (i.e., the distance from the left side 103 to the right side 104) of from about 10 inches to about 14 inches (e.g., about 11 inches, about 12 inches or about 13 inches). In a preferred embodiment, the pillow comprises a length of about 12.6 inches. The pillow may comprise a height (i.e., the distance from the top 101 to the bottom 102) of from about 5 inches to about 9 inches (e.g., about 6 inches, about 7 inches, or about 8 inches). In a preferred embodiment, the pillow comprises a height of about 7 inches. Accordingly, in one preferred embodiment, the pillow comprises a length to height ratio of from about 1.6:1 to about 2:1 (e.g., about 1.8:1).

The width of the pillow is defined as the distance between the front side 105 and the back side 106 thereof. Because the front and back sides (105, 106) are typically concave, the width of the pillow varies along its length. For example, the pillow may be wider at its left and right sides, than at its midpoint (i.e., equidistant from its left and right side along its length).

The concave front and back sides (105, 106) may be symmetric or asymmetric. If symmetric, the specific shape of the concave front and back sides may be defined as a segment of any of a number of curves, e.g., a circle segment, a segment of a parabola or higher order polynomial function, or a segment of a hyperbola, ellipse, catenary, or sine curve.

The pillow may comprise a width (i.e., the distance from the front side 105 to the back side 106) that varies from about 3 inches to about 10 inches. The maximum width of the pillow (i.e., at the left side 103 and right side 104) may be from about 6 inches to about 10 inches (e.g., about 8 inches). The minimum width of the pillow (i.e., at the midpoint between the left side 103 and right side 104) may be from about 3 inches to about 5 inches (e.g., about 4 inches). Accordingly, the pillow may comprise a maximum width to minimum width ratio of from about 3.33:1 to about 1:1 (e.g., about 1.6:1).

The adjustable pillow 100 comprises a cover 110 shaped to be placed about one or more support pieces. The cover may comprise an openable fastening mechanism 117 on a top side 111 thereof. The cover may comprise a single piece of material or may comprise a plurality of panels of material connected via stitching 118 or the like. Generally, the cover 110 defines an interior compartment adapted to hold a plurality of support pieces.

In one embodiment, the cover 110 comprises a top panel 111, a bottom panel 112, a front panel 115, a back panel 116, a left panel 113, and a right panel 114. The panels may be connected along the edges thereof to form a housing. As shown, the panels may be connected to each other via stitching or the like 118.

Figure 2:
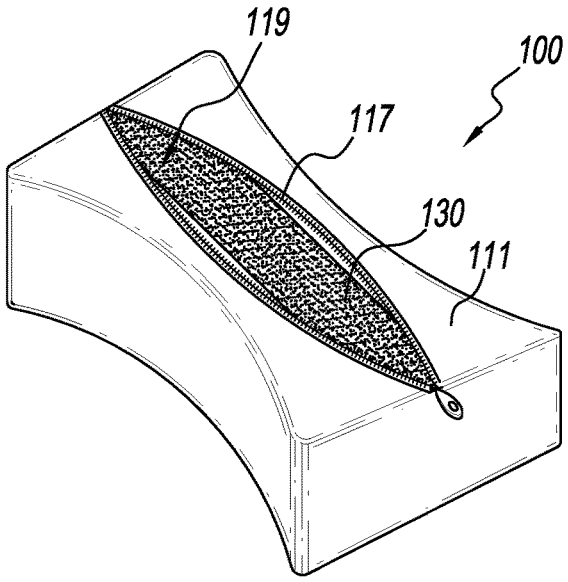
FIG. 2 illustrates the adjustable pillow 100, where the cover fastening mechanism 117 is in an open position to expose an aperture 119.

Referring to FIG. 2, a fastening mechanism 117 located on the top panel 111 of the cover 110 is illustrated in an open position. As depicted, one or more support pieces 130 are disposed within an interior compartment of the cover 110.

The top panel 111 of the cover comprises an aperture 119 extending from an outer surface of the cover 110 to an interior compartment thereof. The aperture 119 is sized such that one or more support pieces 130 may be inserted into and/or removed from an interior compartment of the cover 110 via the aperture 119. Accordingly, in the embodiment where the adjustable pillow 100 has a length of about 12.6 inches, the aperture may extend a length of from about 10 inches to about 12.6 inches.

The cover 110 comprises a fastening mechanism 117 adapted to allow the aperture 119 of the cover 110 to be opened such that one or more support pieces 130 may be inserted into the cover 110. The fastening mechanism 117 is further adapted to allow the aperture 119 to be closed in order to maintain the support pieces 130 securely within the interior compartment of the cover 110. In one embodiment, the fastening mechanism 117 is a zipper. In other embodiments, the fastening mechanism may be selected from the group consisting of: zippers, snaps, buttons, straps, hook and loop fasteners, and combinations thereof.

The aperture 119 and fastening mechanism 117 may be located anywhere along a surface of the cover 110. In one embodiment, the aperture is located along the length of the top panel 111, equidistant from the front and back sides (105, 106) of the cover. In other embodiments, the aperture may be located along an edge of a single side of the cover or may extend along a multiple sides thereof.

Alternatively, the cover 110 may not comprise a fastening mechanism. In such an embodiment, the cover may overlap itself at or near the aperture 119, providing a finished appearance to the cover.

The cover 110 may be adapted to protect the support pieces 130 from wear and tear, environmental elements (bacteria, moisture, dirt, pollen, pollutants and other allergens, etc.) and/or to provide a comfortable feel to a user (with or without an additional pillowcase surrounding the cover). To that end, the cover 110 may comprise one or more materials selected from the group consisting of: cotton, silk, satin, leather, microfiber, bamboo, rayon (e.g., viscose rayon derived from bamboo), polyester, polyurethane, and combinations thereof.

In one preferred embodiment, the cover 110 comprises a blend of polyester and viscose rayon derived from bamboo. Such material may comprise from about 20 percent to about 80 percent rayon (e.g., about 40 percent rayon) and from about 80 percent polyester to about 20 polyester (e.g., about 60 percent polyester). As a specific example, the cover may comprise a blended material of about 40 percent rayon (e.g., viscose rayon derived from bamboo) and about 60 percent polyester. Such a material may allow heat to distribute more evenly across the fabric and thus may contribute to even temperature regulation throughout the adjustable pillow. Moreover, such material is preferred as it is washable, hypoallergenic and dust mite resistant.

In certain embodiments, the cover 110 may comprise a thickness of from about 0.01 inches to about 1 inch. For example, the cover may comprise a thickness of about 0.01 inches, 0.03 inches, about 0.05 inches, about 0.1 inches, about 0.5 inches, about 0.75 inches or about 1.0 inches.

Although not shown, the cover 110 may comprise any number of decorative elements. For example, the cover 110 may include one or more flanges (fabric that extends from one or more side seams); piping (covered cord sewn into the seams as a decorate detail), and/or fringes or beading attached to one or more sides thereof.

Figure 3:
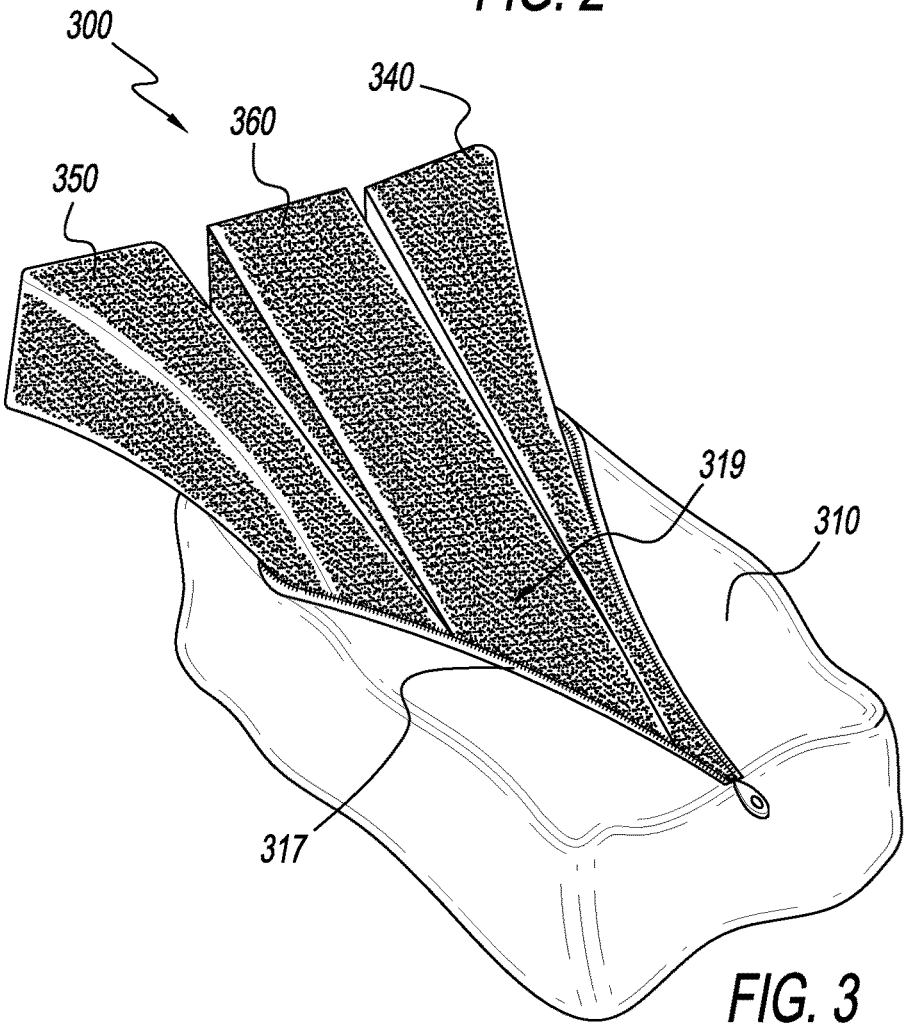
FIG. 3 illustrates a view of an exemplary adjustable pillow 300, where the cover 310 has been partially removed to expose a front support piece 340, a middle support piece 360, and a back support piece 350.

Referring to FIG. 3, a view of an exemplary adjustable pillow 300 is illustrated, where the cover 310 is partially removed to expose a front support piece 340, middle support piece 360, and back support piece 350. As shown, the fastening mechanism 317 is in an open position, allowing for one or more of the support pieces to be inserted into and/or removed from an interior compartment of the cover 310 via the aperture 319.

Each of the front 340, back 350 and middle 360 support pieces may comprise a soft material, such as but not limited to: memory foam, polyurethane foam, latex foam, closed cell foam, high density foam, supreem foam, evlon foam, high resilience foam, and/or combinations thereof. Each of the support pieces may comprise the same material or may comprise different materials.

Density is a property of a material defined by its mass divided by its volume. Resilience describes the ability and length of time required for a material to return to its original shape after it has been deformed. Firmness is measured as Indentation Load Deflection ("ILD"). To determine the ILD of a foam product, a sample measuring 15 inches by 15 inches by 4 inches is used and the force in pounds that it takes a 50 square-inch circular indenter to compress the material 1 inch (i.e., 25 percent of its thickness) is recorded. For example, if the sample requires 36 pounds of pressure to indent it 1 inch, its ILD is 36.

Different types of foam materials have a range of applicable densities and firmness. For example, typical polyurethane foam has a density of about 1.2 lbs. per cubic ft. and an ILD (firmness) of about 33. High density foam has a density of about 1.9 lbs. per cubic ft. and an ILD of from about 52 to about 58.

Memory foam, also referred to as viscoelastic polyurethane foam, is a polyurethane foam with additional chemicals added to increase density and lower firmness and resilience. Memory foam is softer than other foams, but is less supportive. Memory foam has a density of about 2 lbs. per cubic ft. to about 8 lbs. per cubic ft. and an ILD of from about 9 to about 16.

In certain embodiments, the outer support pieces (e.g., the front 340 and back 350 support pieces) may comprise a first material and the inner support piece(s) 360 may comprise a second material. The first material may have a lower firmness (i.e., be softer) than the second material to provide more comfort to the user's knees. The second material may be a more supportive material, with a higher firmness than the first material. More specifically, the first material may have a density of from about 2.5 lbs. per cubic ft. to about 8 lbs. per cubic ft., while the second material may have a density of from about 1 lb. per cubic ft. to about 3 lbs. per cubic ft. The first material may have a firmness (i.e., ILD) of from about 9 to less than about 20, while the second material may have a firmness of from about 20 to about 150.

As an example, the first material of the front 340 and back 350 support pieces may comprise a foam having a density of between about 2.8 lbs. per cubic ft. and about 6 lbs. per cubic ft., and a firmness of between about 9 and about 15 (e.g., memory foam). The second material of the inner support piece(s) 360 may comprise a foam having a density of between about 1.2 lbs. per cubic ft. and about 2 lbs. per cubic ft., and a firmness of between about 30 and about 40 (e.g., polyurethane foam).

The aperture 319, illustrated with a zipper as the fastening mechanism 317, is placed to provide easy access to at least the middle support piece(s) 360. The aperture 319, as illustrated, also provides access to the front support piece 340 and back support piece 350, but this is not required.

The aperture 319 is shown of sufficient size to allow for the removal of the front and back support pieces. In an alternative embodiment, the aperture 319 may be sized to only allow removal of the middle support piece 360. In addition, the aperture 319 is shown placed along the length of the cover 310, but the aperture 319 may be placed anywhere on the cover 310 that allows the user access to the middle support piece 360. In one embodiment, the front and back support pieces may be attached to the inner surface of the cover 310 and, therefore, are not removable.

While FIG. 3 shows an exemplary adjustable pillow 300 with one middle support piece 360, it will be appreciated that more than one middle support piece may be employed. In this embodiment, the multiple middle support pieces may be the same height, or may be of varying heights. For example, the pillow may comprise two middle support pieces, each with a height of 0.5 inches. As an alternative example, the pillow may comprise two middle support pieces, one with a height of 0.25 inches, the other with a height of 0.75 inches. This embodiment allows the user to make finer adjustments to the height of the pillow according to the user's needs.

In embodiments where multiple middle support pieces are used, each middle support piece may comprise the same material. In other embodiments, each middle support piece may comprise a different material, allowing the user finer control of the feel and support of the pillow. Each different material may have a different density and/or firmness, and the combination of inner support pieces of varying density and firmness will allow the adjustable pillow to accommodate a range of user needs. For example, if three middle support pieces are used, and the innermost middle support piece may have a greater firmness than the surrounding middle support pieces, which in turn may have a greater firmness than the front and back support pieces. In this way, a more gradual increase in firmness between the front and back support pieces and the innermost middle support piece will be accomplished.

Figure 4A:
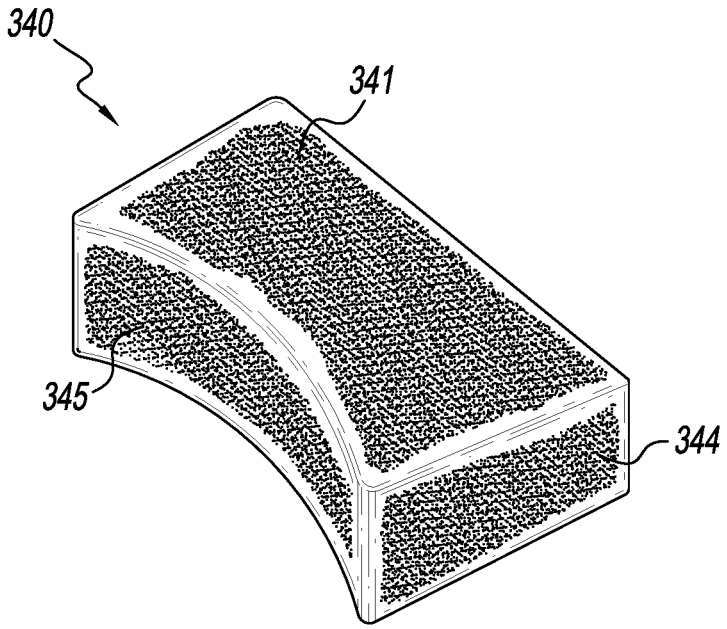
FIGS. 4A and 4B illustrate top and bottom perspective views of the front support piece 340, which may be substantially identical to the back support piece 350.
Figure 4B:
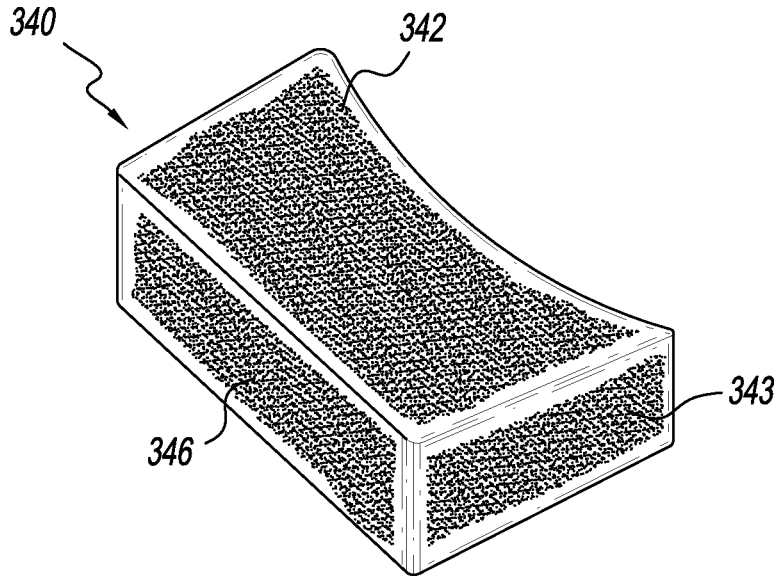

Referring to FIGS. 4A and 4B, top and bottom perspective views of the front support piece 340 are illustrated. The front support piece comprises a top 341, a bottom 342, a left side 343, a right side 344, a front 345, and a back 346. The top, bottom, left side, right side, and back of the front support piece are substantially flat. The front 345 of the front support piece 340 is concave.

In one embodiment, the length of the front support piece 340 (defined as the distance between the left side 343 and the right side 344) is from about 10 inches to about 14 inches (e.g., about 12.6 inches). The height of the front support piece, defined as the distance between the top 341 and the bottom 342, is from about 5 inches to about 9 inches (e.g., about 7 inches).

The width of the front support piece (defined as the distance between the front 345 and the back 346) varies from about 1 inch to about 5 inches along the length of the support piece. The width may be from about 1 inch to about 3 inches at the midpoint of the length, and from about 3 inches to about 5 inches at the left and right sides.

The back support piece 350 may be substantially similar to the front support piece. It will be appreciated that, when seated in the interior compartment of the cover, the back support piece 350 is flipped in orientation to the front support piece, such that the concave back side of the back support piece faces the opposite direction as the front side 345 of the front support piece 340.

Figure 5A:
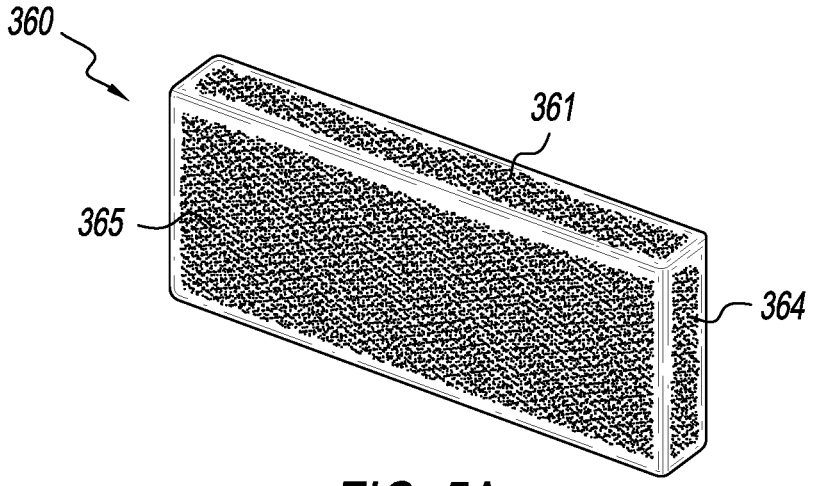
FIGS. 5A and 5B illustrate top and bottom perspective views of the middle support piece 360.
Figure 5B:
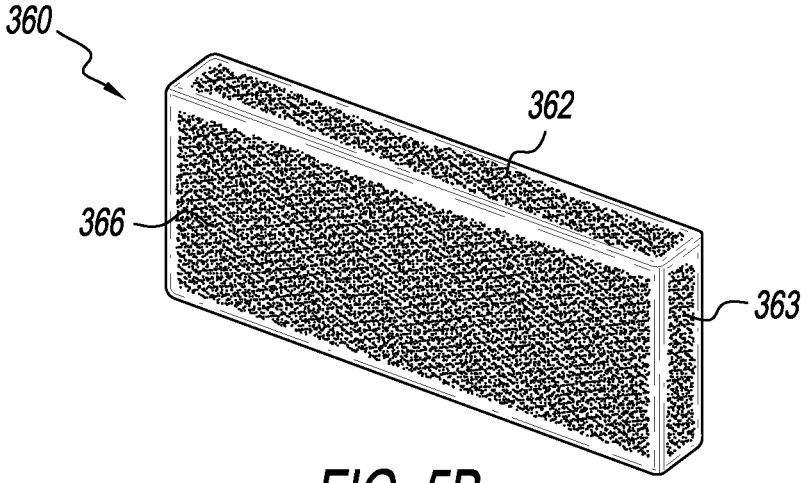

Referring to FIGS. 5A and 5B, top and bottom perspective views of the middle support piece 360 are illustrated. As shown, the middle support piece 360 comprises a substantially flat top 361, bottom 362, front 365, back 366, left side 363, and right side 364. The length (defined as the distance between the left side 363 and the right side 364) and height (defined as the distance between the top 361 and the bottom 362) of the middle support piece 360 may be substantially similar to the length and height of the front 340 and back 350 support pieces.

The width of the middle support piece 360 (defined as the distance between the front 365 and the back 366) may be from about 0.25 inches to about 2 inches. In one exemplary embodiment, the width of the middle support piece is approximately 1 inch. In the embodiment where more than one middle support piece is used, the width of each middle support piece may be from about 0.25 inches to about 1 inch.

Figure 6:
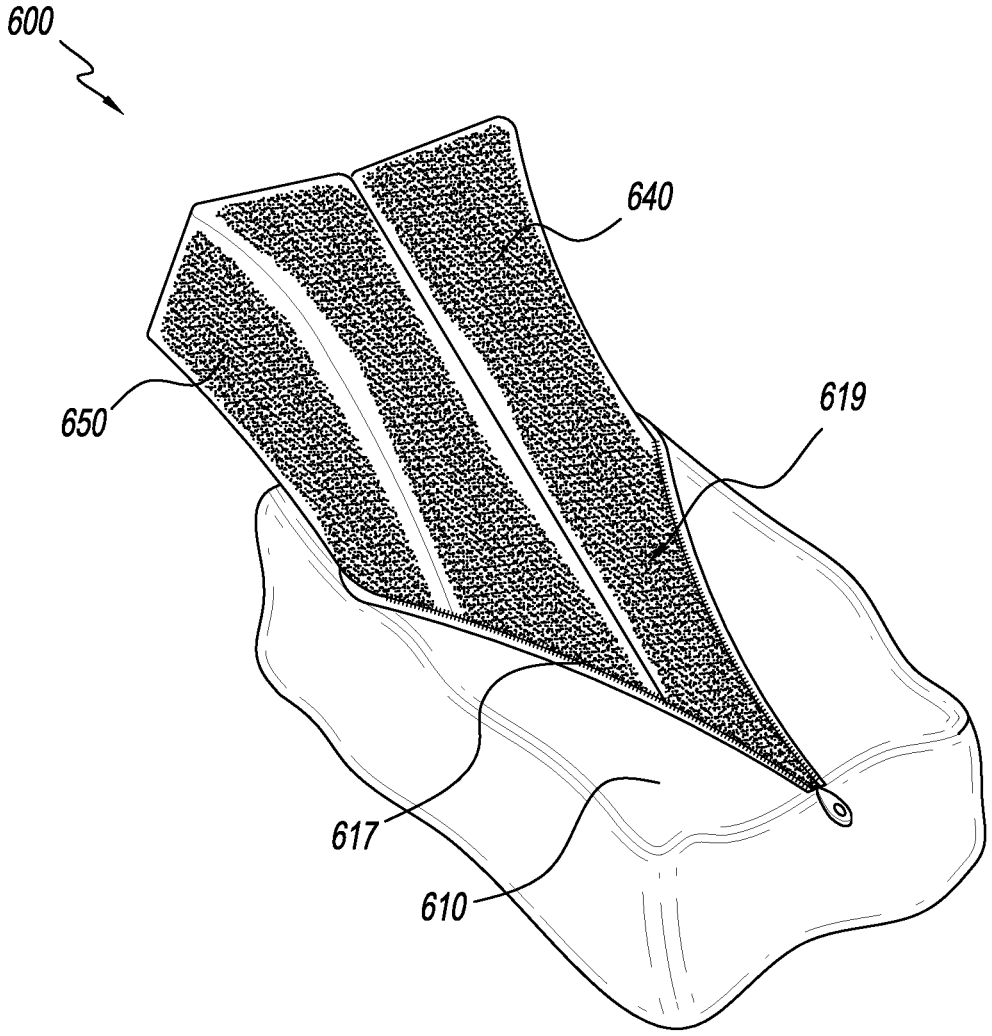
FIG. 6 illustrates a view of an alternative embodiment of the adjustable pillow 600 having a middle support piece removed, where the cover 610 has been partially removed to expose a front support piece 640 and a back support piece 650.

Referring to FIG. 6, a view of an alternative embodiment of the adjustable pillow 600 is illustrated, where a cover 610 has been partially removed to expose a front support piece 640 and a back support piece 650. A fastening mechanism 617 of the cover is shown in an open position, and a middle support piece (see, e.g., FIG. 3 at 360) has been removed from the cover 610 via the aperture 619.

The illustrated embodiment shows the adjustability of adjustable pillow 600. With the middle support piece removed, the width of the pillow 600 is reduced, but the pillow still retains the ability to support the user's knees, back, and/or spine in proper alignment. In addition, if the middle support piece is made of a material with a different density and/or firmness than the front and back support pieces, the removal of the middle support piece may change the feel of the pillow, such as the overall density or firmness. In an embodiment where the adjustable pillow comprises more than one middle support piece, one or more of the middle support pieces may be removed to allow the user finer control over the width and/or feel of the pillow.

In an alternative embodiment, no cover, such as cover 610, may be used. In this embodiment, each of the support pieces may have its own cover. In this embodiment, the support pieces may be attached together using a temporary securing means, such as hook and loop fasteners and/or a temporary adhesive.

Various embodiments are described in this specification, with reference to the detailed discussed above, the accompanying drawings, and the claims. Numerous specific details are described to provide a thorough understanding of various embodiments. However, in certain instances, well-known or conventional details are not described in order to provide a concise discussion. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the embodiments. In this regard, directional terminology, such as "vertical," "horizontal," "top," "bottom," "front," "back," "left," "right," etc., is used with reference to the orientation of the drawing (s) being described. Because components of the embodiments can be positioned in a number of different orientations, the directional terminology is used for purposes of illustration and is in no way limiting.

The embodiments described and claimed herein and drawings are illustrative and are not to be construed as limiting the embodiments. The subject matter of this specification is not to be limited in scope by the specific examples, as these examples are intended as illustrations of several aspects of the embodiments. Any equivalent examples are intended to be within the scope of the specification. Indeed, various modifications of the disclosed embodiments in addition to those shown and described herein will become apparent to those skilled in the art, and such modifications are also intended to fall within the scope of the appended claims.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

All references including patents, patent applications and publications cited herein are incorporated herein by reference in their entirety and for all purposes to the same extent as if each individual publication or patent or patent application was specifically and individually indicated to be incorporated by reference in its entirety for all purposes.

what is claimed is:

1. An adjustable pillow comprising:

a cover comprising:

a plurality of panels joined to form an outer surface, an inner surface and an interior compartment, the interior compartment sized to house a plurality of support pieces therein;

a closable aperture extending from the outer surface to the inner surface along one or more of the panels, the aperture sized to receive one or more support pieces therein; and a fastening mechanism in communication with the aperture, the fastening mechanism adapted to allow a user to:

open the aperture for insertion of one or more support pieces into the interior compartment; and securely close the aperture such that the one or more support pieces remain within the interior compartment during use;

a front support piece disposed within the interior compartment of the cover, the front support piece comprising:

a concave front surface;

a substantially flat back surface; and substantially flat left, right, top and bottom surfaces extending from the front surface to the back surface, wherein the front support piece comprises a first material, wherein the front support piece comprises a length of from about 10 inches to about 14 inches, and wherein the front support piece comprises a height of from about 5 inches to about 8 inches;

a back support piece disposed within the interior compartment, the back support piece comprising:

a concave back surface;

a substantially flat front surface; and substantially flat left, right, top and bottom surfaces extending from the back surface to the front surface, wherein the back support piece comprises the first material, wherein the back support piece comprises a length of from about 10 inches to about 14 inches, and wherein the back support piece comprises a height of from about 5 inches to about 8 inches; and a removable middle support piece disposed within the interior compartment, between the back surface of the front support piece and the front surface of the back support piece, the middle support piece comprising substantially flat front, back, left, right, top and bottom surfaces, wherein the middle support piece comprises a second material having a second firmness that is greater than a firmness of the first material of the front and back support pieces, wherein the middle support piece comprises a length that is substantially similar to the length of the front and back support pieces, and wherein the middle support piece comprises a height that is substantially similar to the height of the front and back support pieces; and wherein the pillow is adapted to receive at least a portion of a user's legs during use.

2. An adjustable pillow according to claim 1, wherein the cover is adapted to fit around the front support piece, middle support piece, and back support piece, while substantially retaining the shape of the respective support pieces.

3. An adjustable pillow according to claim 1, wherein the fastening mechanism comprises one or more fasteners selected from the group consisting of: zippers, snaps, buttons, straps, and hook-and-loop fasteners.

4. An adjustable pillow according to claim 3, wherein the fastening mechanism is a zipper.

5. An adjustable pillow according to claim 1, wherein the cover comprises one or more materials selected from the group consisting of: cotton, silk, satin, leather, microfiber, bamboo, rayon, polyester, polyurethane, and combinations thereof.

6. An adjustable pillow according to claim 5, wherein the cover comprises about 40 percent rayon and about 60 percent polyester.

7. An adjustable pillow according to claim 1, wherein the first material of the front support piece and the back support piece comprises a foam having an Indentation Load Deflection (ILD) of less than 20.

8. An adjustable pillow according to claim 7, wherein the second material of the middle support piece comprises a foam having an ILD of 20 or greater.

9. An adjustable pillow according to claim 8, wherein:

the first material of the front support piece and back support piece is memory foam; and the second material of the middle support piece is a high-density polyurethane foam.

10. An adjustable pillow according to claim 1, further comprising one or more additional middle support pieces.

11. An adjustable pillow according to claim 1, wherein the front support piece and back support piece each comprises a length of about 12.6 inches.

12. An adjustable pillow according to claim 1, wherein the aperture is disposed in proximity to the middle support piece and is sized to allow for removal of the middle support piece.

13. An adjustable pillow according to claim 1, wherein the front support piece and back support piece each comprise a height of about 7 inches.

14. An adjustable pillow according to claim 1, wherein the middle support piece comprises a width of from about 0.25 inches to about 1 inch.

15. An adjustable pillow according to claim 14, wherein the front support piece and back support piece each comprise a maximum width of from about 6 inches to about 10 inches and a minimum width of from about 3 inches to about 5 inches.

16. An adjustable pillow according to claim 1, wherein:

the front support piece and back support piece each comprise:

a length of about 12.6 inches;

a height of about 7 inches;

a maximum width of about 7 inches; and a minimum width of from about 3 inches to about 5 inches;

the middle support piece comprises:

a length of about 12.6 inches;

a height of about 7 inches; and a width of about 1 inch;

the first material of the front support piece and back support piece is memory foam; and the second material of the middle support piece is a high-density polyurethane foam.

17. An adjustable pillow according to claim 16, wherein the cover comprises about 40 percent rayon and about 60 percent polyester.

* * * * *